US005876251A

United States Patent [19]

Muta

[11] Patent Number: 5,876,251

[45] Date of Patent: Mar. 2, 1999

[54] L-SHAPED BULB CONNECTOR

[75] Inventor: Junji Muta, Yokkaichi, Japan

[73] Assignee: Sumitomo Wiring Systems, Ltd., Japan

[21] Appl. No.: 889,173

[22] Filed: Jul. 7, 1997

[30] Foreign Application Priority Data

Jul. 4, 1996 [JP] Japan ..... 8-175151

[51] Int. Cl.[6] ..... H01R 17/00

[52] U.S. Cl. ..... 439/699.2

[58] Field of Search ..... 439/617, 619, 439/699.1, 699.2, 356, 736

[56] References Cited

U.S. PATENT DOCUMENTS

| | | | |
|---|---|---|---|
| 3,805,211 | 4/1974 | Moore . | |
| 4,871,331 | 10/1989 | Kondo et al. . | |
| 5,035,643 | 7/1991 | Forish et al. . | |
| 5,507,670 | 4/1996 | Ogawa | 439/617 |
| 5,558,543 | 9/1996 | Takano et al. | 439/699.2 |
| 5,695,367 | 12/1997 | Takano et al. | 439/699.2 |

FOREIGN PATENT DOCUMENTS

| | | |
|---|---|---|
| 0289687 | 11/1988 | European Pat. Off. . |
| 0642196 | 3/1995 | European Pat. Off. . |
| 0668638 | 8/1995 | European Pat. Off. . |
| 2267606 | 12/1993 | United Kingdom . |

*Primary Examiner*—Khiem Nguyen
*Attorney, Agent, or Firm*—Jordan B. Bierman; Bierman, Muserlian and Lucas

[57] ABSTRACT

A spring contact, biased toward a retaining plate, holds the connection terminal in good electrical contact. The resilience of the spring contact permits relative movement between the contacts, thereby accommodating dimensional changes resulting from variations in ambient temperatures. The spring contact may be on the bulb terminal or on the connector terminal. An engaging element is provided on the leading end of the connection terminal; this element engages a retainer on the bulb terminal to further secure the components in their desired position.

5 Claims, 7 Drawing Sheets

L-SHAPED BULB CONNECTOR

This Application claims the benefit of the priority of Japanese Application 8-175151, filed Jul. 4, 1996.

The present Invention is directed to an improved bulb connector wherein the bulb socket and connector socket are at right angles to each other. More specifically, the Invention is intended to minimize or eliminate the strains which can be imparted to the components of the connector as a result of variations in the ambient temperature to which the connector is subjected.

BACKGROUND OF THE INVENTION

A typical prior art device is depicted in FIGS. 11 and 12. Main housing 1 comprises bulb socket 2 and connector socket 3 at right angles to each other. Connector terminal 4 is located within connector socket 3 and is adapted to be electrically connected to power supply connection B. Bulb terminal 5 is located in bulb socket 2 and is adapted to receive the contact portion of bulb A.

To assemble the device, connector terminal 4 is inserted into housing 1 in the horizontal direction as shown in FIG. 11. Correspondingly, bulb terminal 5 is inserted into bulb socket 2 in a vertical direction as shown in FIG. 11. Fitting hole 4B is formed in leading end 4A of connector terminal 4 and insertion end 5A of bulb terminal 5 is inserted therethrough. In this way, the parts are locked together and electrical contact is maintained.

However, such prior art devices suffer from some important defects. Both terminals 4 and 5 are pressed into main housing 1 in their respective directions. As a result, their ability to displace relative to one another is extremely limited. Such movement is further limited by the insertion of end 5A into fitting hole 4B. Thus, there is little or no flexibility between the two terminals and also between either of the terminals and the main housing. Since the housing is normally made of synthetic resin, it has a tendency to expand and contract as the ambient temperature rises and falls. Since the device is intended for use in an automobile, these temperature differences can be substantial. When this occurs, undesirable stresses are induced, especially between terminals 4 and 5 at their point of connection 4A, 5A.

SUMMARY OF THE INVENTION

The present Invention will be specifically described with respect to a connector between a bulb and a power source; however, it is understood that other electrical units can replace those specifically named. The present Invention comprises a device for interconnection of a bulb with a power source wherein there is provided a generally cylindrical bulb socket having a first longitudinal axis. A bulb opening is provided at the first end through which the bulb itself is inserted into the connector. There is also provided a generally cylindrical connector socket with a second longitudinal axis having a power source opening at its outer end. The connector socket receives the connection from the power source through the aforementioned opening. The first axis is substantially at a right angle to the second axis, whereby the device is L-shaped.

There is a connection chamber between the bulb socket and the connector socket in communication with the inner ends of the both. The connector terminal is located in the connector socket and is preferably relatively long and narrow. The leading end extends into the connection chamber and, in one embodiment of the Invention, an engaging element is mounted thereon.

There is a bulb terminal in the bulb socket which has an insertion end extending into the connection chamber. The insertion end includes a cantilevered spring contact with its proximal end fixed to the insertion end. There is also a retaining plate near the spring contact at a point spaced apart from the proximal end. The spring contact is biased toward the retaining plate, thereby holding the leading end between the plate and the spring contact.

In a refinement of the Invention, the retaining plate has a window or groove preferably at the point at which the retaining plate and spring contact are nearest each other. The window or groove advantageously can extend from the edge of the retaining plate nearest the connection socket to a point just short of the edge remote therefrom.

In this embodiment, the engaging element is a U-shaped member having the distal end of one leg fixed to the leading end of the connector terminal. As the connector terminal is inserted between the retaining plate and the spring contact, the resilience of the latter permits the contact to flex, thereby easing the passage of the engaging element. At the same time, to avoid over-flexing the spring contact, a portion of the U-shaped member will extend into the groove or window. When the end of the groove or window remote from the connector socket is reached, the U-shaped member rides up over the edge and hooks onto the retainer portion of the retaining plate.

It has been found useful to provide the insertion end with a generally planar support substantially parallel to—and spaced apart from—the retaining plate, with the spring contact between the plate and the support. A portion of the spring contact, desirably the distal end, will bear against the support when the contact has been flexed by the insertion of the leading end of the connector terminal. This helps to prevent the spring contact from being over-flexed and distorted.

It has been found advantageous to provide one or more stops on the connector terminal which bear against a corresponding shoulder on the main housing. The distance between the stop and the engaging element is slightly greater than the distance between the shoulder and the retainer. As a result, slight movement in either direction along the line of insertion of the connector terminal is permitted.

Thus, when the connector is subjected to substantial variations in temperature, and the relative dimensions thereof are changed thereby, the resilience of the spring contact and the ability of the connector terminal to move prevents or minimizes stresses and strains which would otherwise be engendered. In addition, since the spring contact can be strongly biased toward the retaining plate, the leading end of the connector terminal is firmly held therebetween. As a result, a combination of minimization of stress and reliability of electrical contact are achieved by the present Invention.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
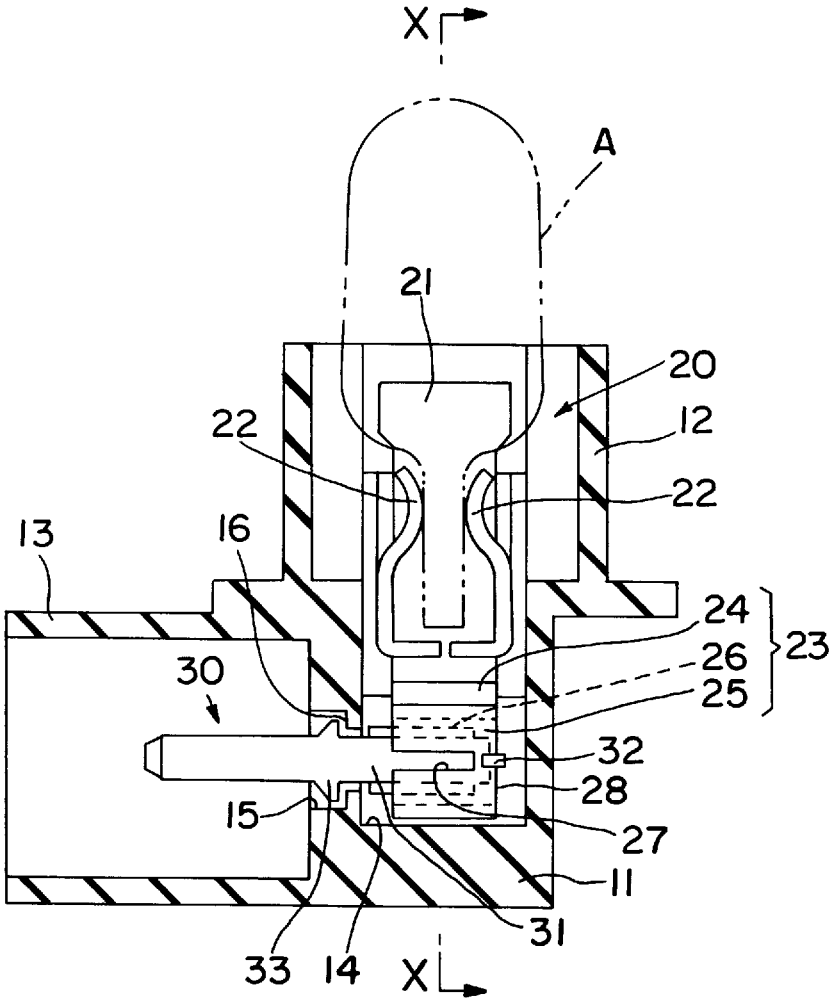
FIG. 1 is a cross-section of the connector assembled.
Figure 2:
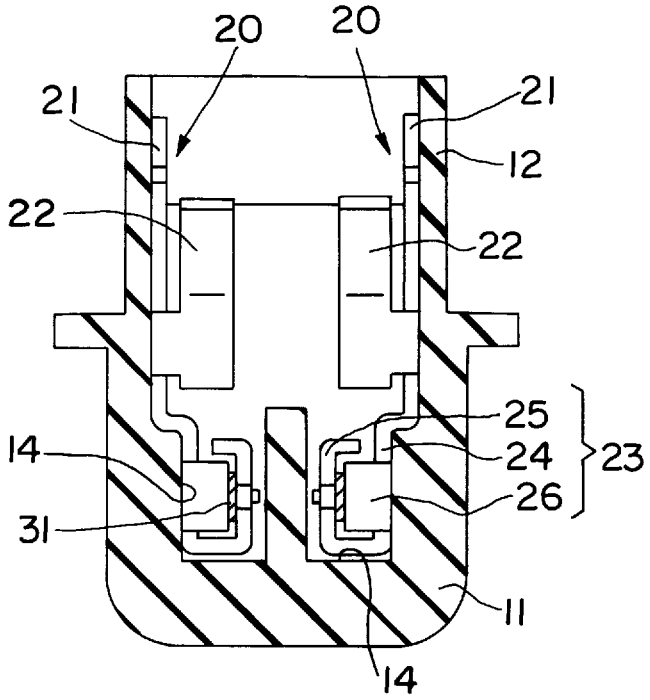
FIG. 2 is a cross-section along the line X—X of FIG. 1.

The device of the present Invention comprises main housing 11 with bulb socket 12 and connector socket 13 at right angles to each other. Connection chamber 14 is located between bulb socket 12 and connector socket 13 and is in communication therewith. Bulb terminal 20 is located in bulb socket 12 and connector terminal 30 is in connector socket 13. Bulb A (shown in phantom lines) can be inserted into bulb socket 12.

Connector terminal 30 comprises leading end 31 carrying engaging element 32 at one end thereof. Stops 33 protrude in a direction transverse to the insertion direction of connector terminal 30 and are adapted to bear against shoulder 16 in insertion opening 15. Thus, connector terminal 30 is inserted into insertion opening 15 until stops 33 abut shoulder 16. At this point, engaging element 32 extends beyond retainer 28 so that insertion end 24 can be hooked over the retainer. Connector terminal 30 is then withdrawn a short distance so that retainer 28 is engaged by element 32.

Bulb terminal 20 is provided with side wall 21 and bulb contacts 22. Insertion end 23 includes support 24, retainer plate 25, and spring contact 26. Retaining plate 25 is provided with window 27 terminating, at a point remote from connector socket 13, in retainer 28.

Figure 3:
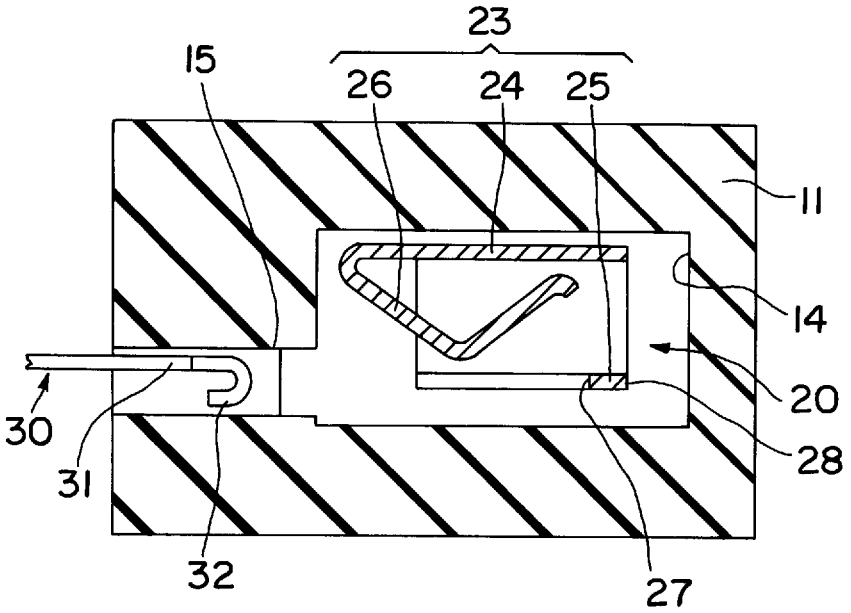
FIG. 3 is a fragmentary cross-section at an initial stage of insertion.
Figure 4:
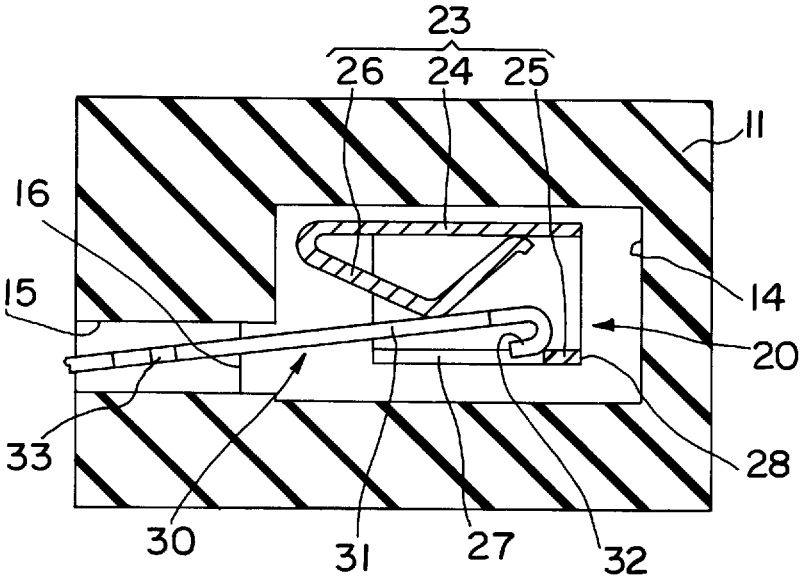
FIG. 4 is similar to FIG. 3 showing an intermediate stage of insertion.
Figure 5:
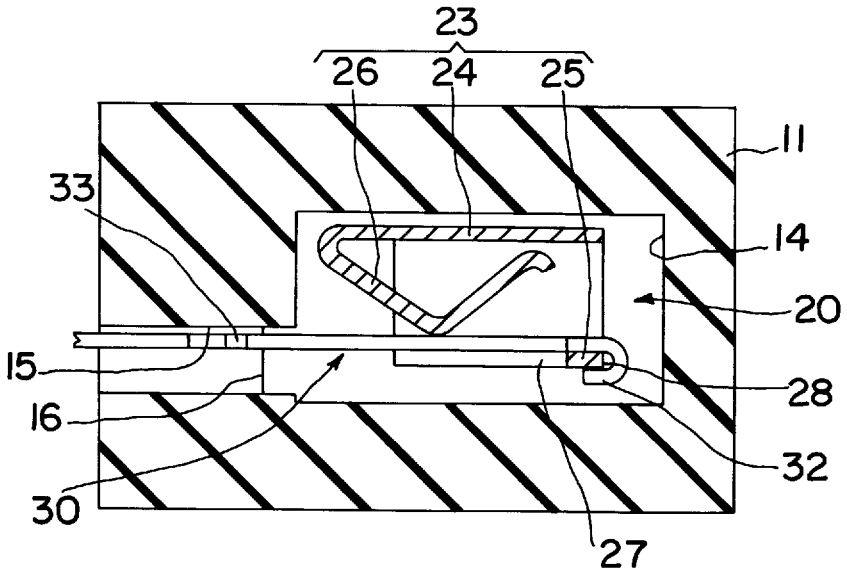
FIG. 5 is similar to FIG. 3 showing complete insertion.
Figure 6:
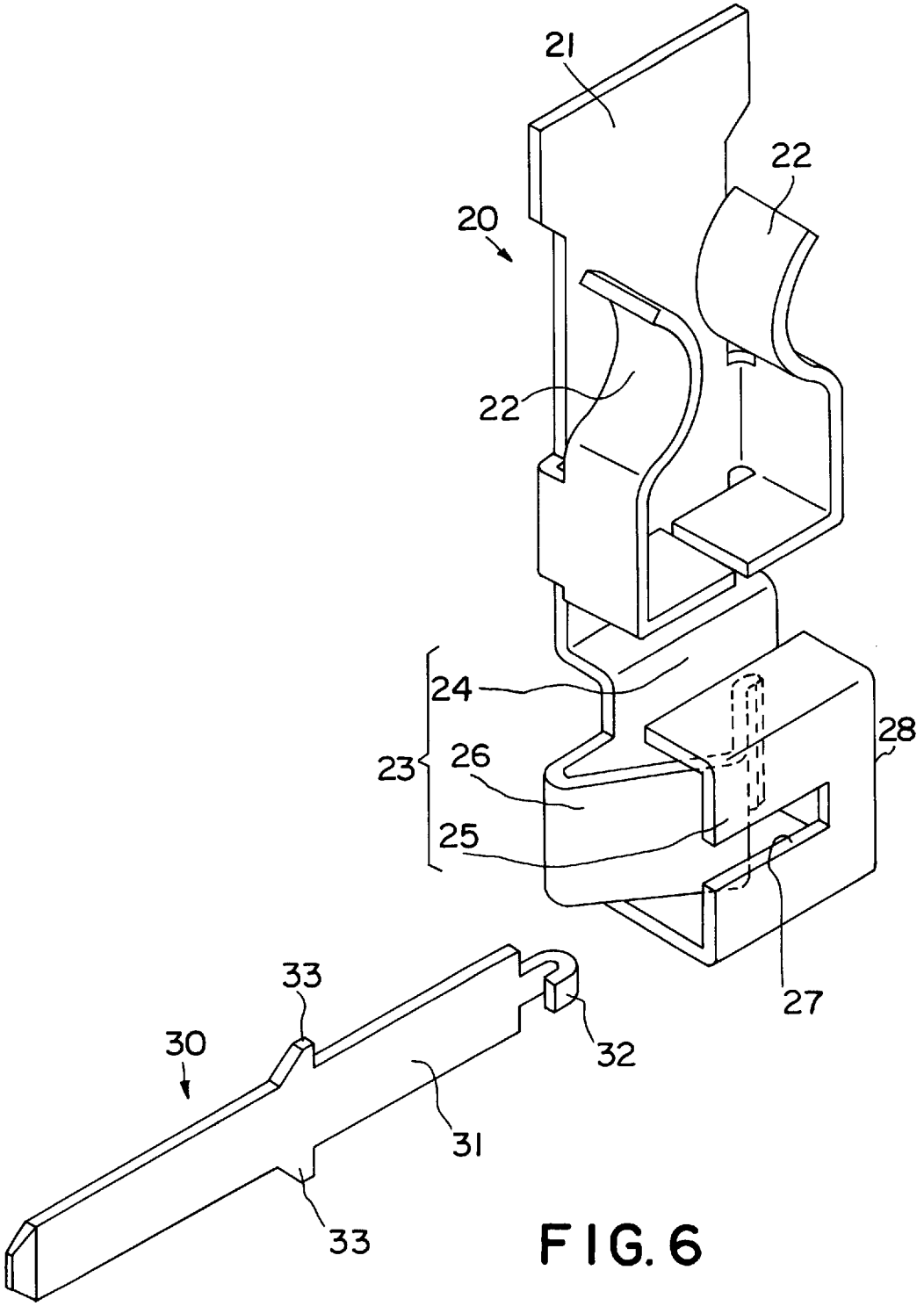
FIG. 6 is a perspective exploded view showing the connector terminal and the bulb terminal.

Assembly of the device is best shown in FIGS. 3 to 5. Bulb terminal 20 (see FIG. 1) is inserted into bulb socket 12 so that insertion end 23 is located in connection chamber 14. Thereafter, connector terminal 30 is introduced through insertion opening 15 toward insertion end 23 (see FIG. 3). The intermediate position is shown in FIG. 4. Leading end 31 is urged by spring contact 26 toward retaining plate 25. For a portion of its passage, the distal end of engaging element 32 has projected through window 27. At the position shown in FIG. 4, engaging element 32 has begun to ride up over retainer 28 of retaining plate 25.

In its final position (FIG. 5), engaging element 32 has passed over retainer 28 and engages it. Spring contact 26 continues to urge connector terminal 30 against retaining plate 25, thereby insuring good electrical contact. Engaging element 32 is hooked over retainer 28 so that connector terminal 30 is securely attached to insertion end 23 of the bulb terminal. At the same time, the resilience of spring contact 26 and the gap between retainer 28 and the inside of engaging element 32 permit flexibility of the components to accommodate distortions due to temperature changes.

Figure 7:
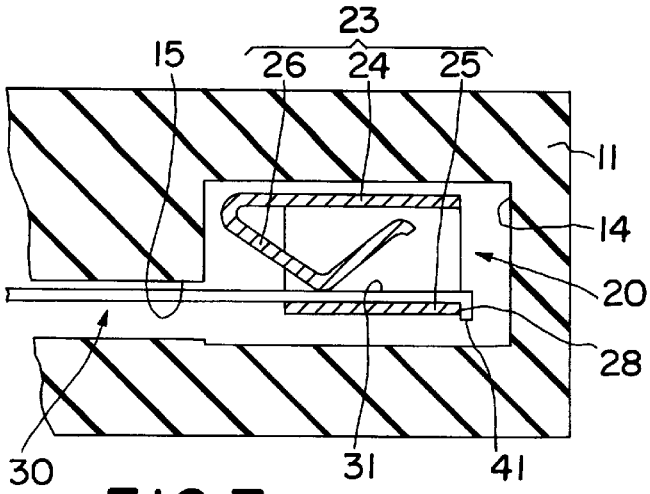
FIG. 7 is similar to FIG. 5 showing a second embodiment of the present Invention.

A second embodiment of the Invention is shown in FIG. 7. The difference between this embodiment and the first embodiment resides in rim 41 which replaces U-shaped member 32. The combination of rim 41 and the pressure of spring contact 26 serves to hold connector terminal 30 securely in its proper position and in electrical contact with the bulb terminal, while still permitting movement of connector terminal 30 along the direction of its insertion.

Figure 8:
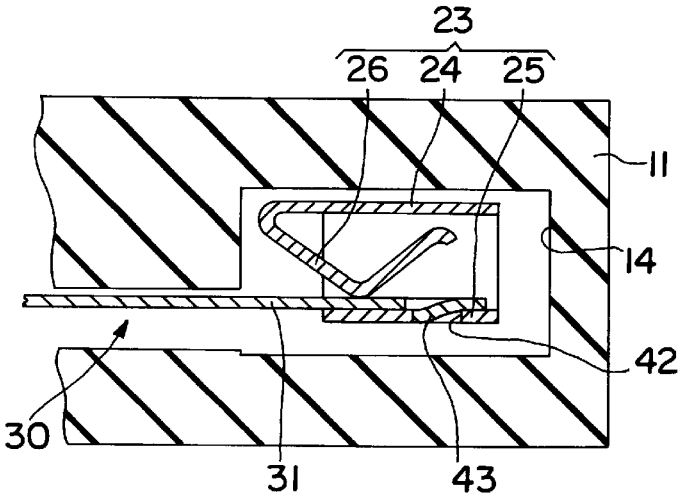
FIG. 8 is similar to FIG. 7 showing a third embodiment of the present Invention.

FIG. 8 shows a third embodiment of the Invention. In this form of the device, locking hole 42 is provided in retaining plate 25. Claw 43 is bent downwardly from connector terminal 30. When insertion end 31 is introduced between retaining plate 25 and spring contact 26, the distal end of claw 43 enters locking hole 42. If withdrawing tension is exerted on connector terminal 30, the distal end of claw 43 bears against a side of locking hole 42 to retain connector terminal 30 in contact with the bulb terminal. Here, too, the provision of a gap (not shown) between the distal end of claw 43 and the adjacent side of locking hole 42 permits the desired movement of connector terminal 30 along its insertion direction.

Figure 9:
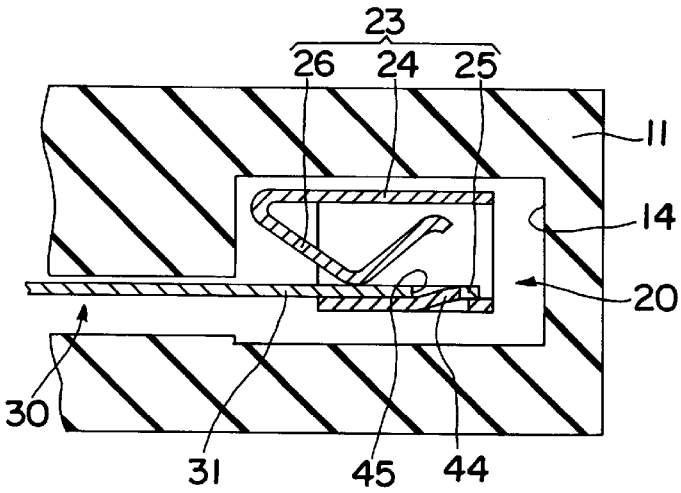
FIG. 9 is similar to FIG. 7 showing a fourth embodiment of the present Invention.

A variation on the foregoing embodiment is to be found in FIG. 9. In this case, the parts are reversed and locking opening 45 is in leading end 31 of connector terminal 30. Correspondingly, claw 44 is bent toward support 24 from retaining plate 25. In a manner similar to the embodiment of FIG. 8, an attempt to withdraw connector terminal 30 is resisted by the distal end of claw 44 bearing against the side of locking opening 45, while allowing movement along the insertion direction of connector terminal 30.

Figure 10:
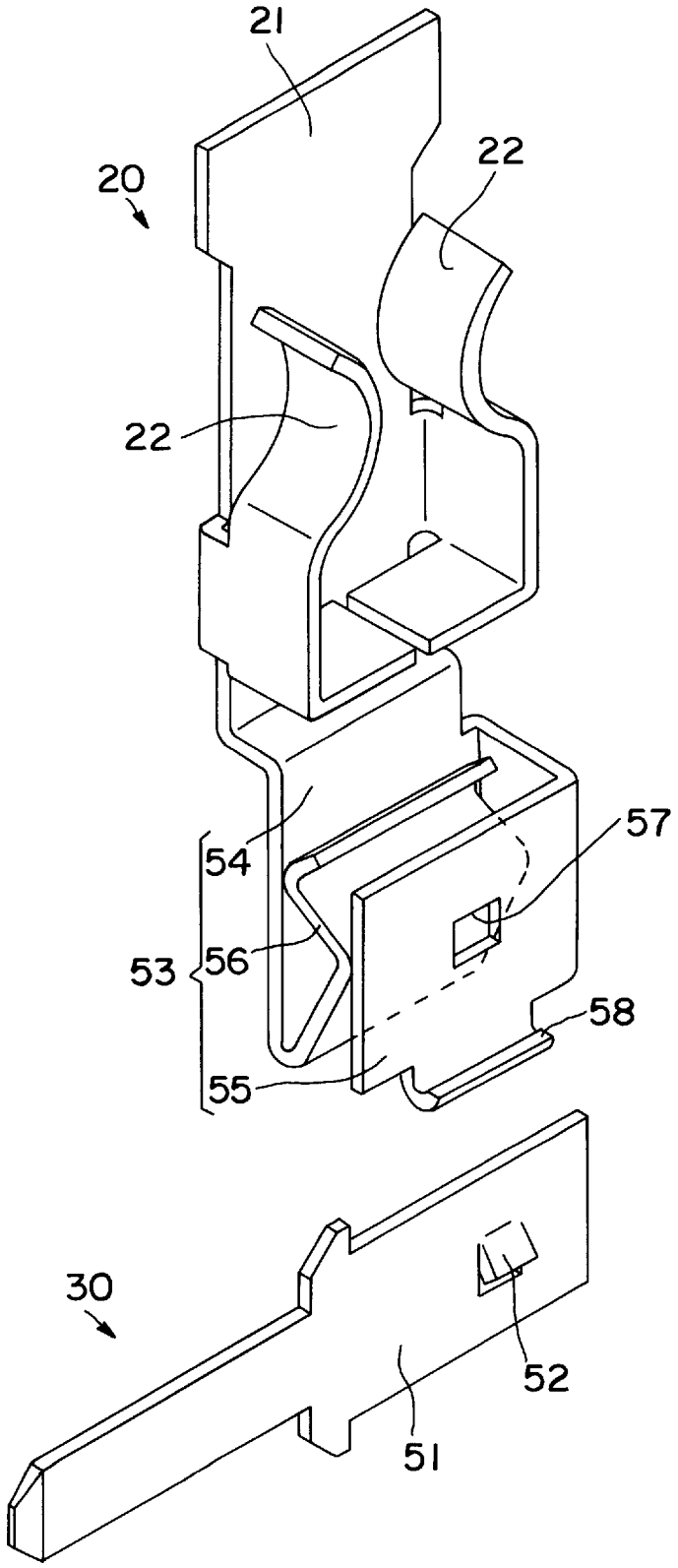
FIG. 10 is similar to FIG. 6 showing a fifth embodiment of the present Invention.
Figure 11:
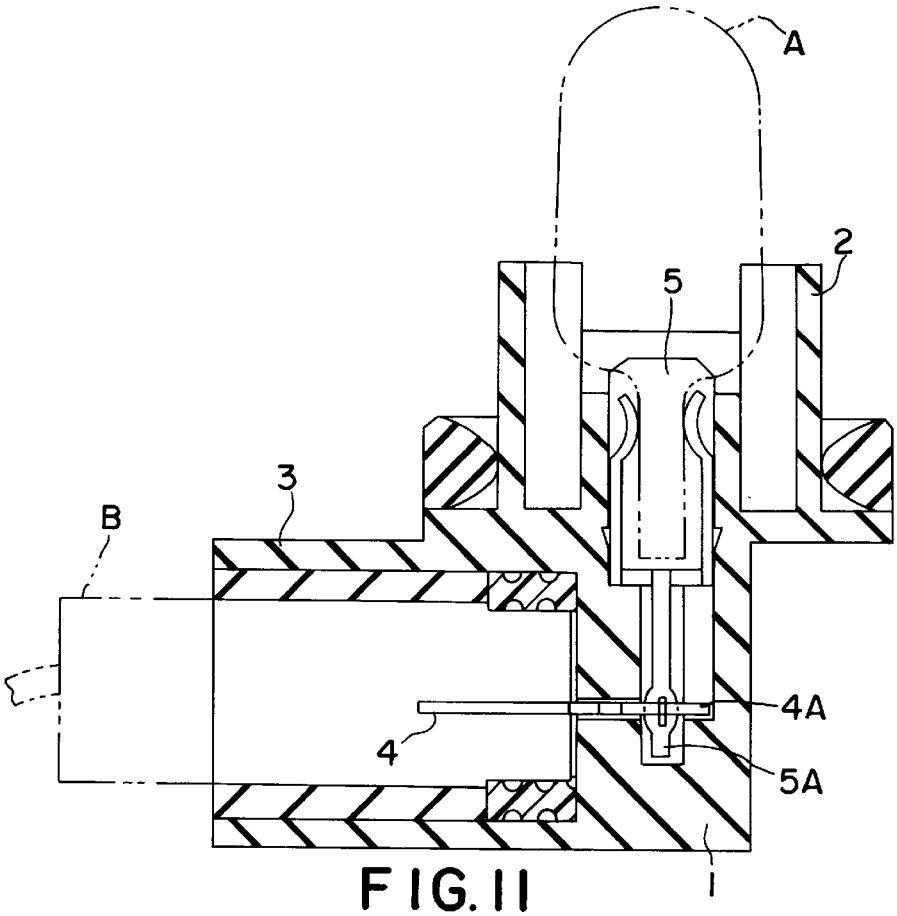
FIG. 11 PRIOR ART
FIG. 11 is similar to FIG. 1 showing a prior art device.
Figure 12:
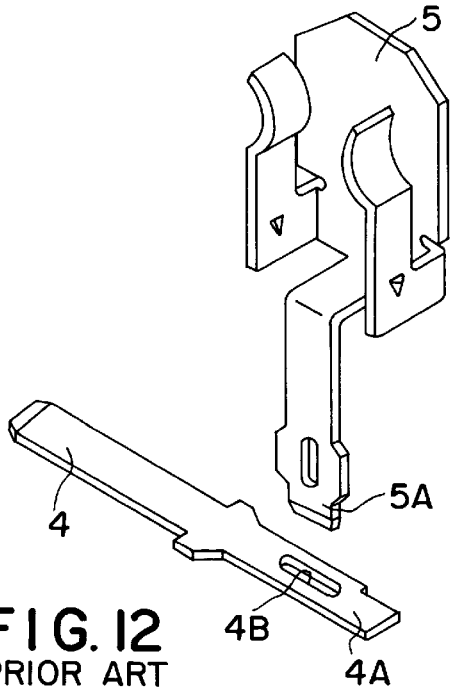
FIG. 12 PRIOR ART
FIG. 12 is similar to FIG. 6 showing the prior art device of FIG. 11.

A further embodiment of the Invention is shown in FIG. 10. In this case, assembly is carried out by first inserting leading end 51, provided with claw 52, of connector terminal 30 into the main housing. Corresponding to claw 52 is window 57 in retaining plate 55. Insertion end 53 of bulb terminal 20 also includes spring contact 56 and support 54. Thus, as bulb terminal 20 is inserted, guide 58 rides over the slanted surface of claw 52 until window 57 is in register therewith. Claw 52 then enters window 57 and the distal end thereof bears against the side of window 57, thereby preventing withdrawal of bulb terminal 20. By suitable selection of the sizes of claw 52 and window 57, the desired ability of bulb terminal 20 to move vertically (as shown in FIG. 10) relative to connector terminal 30 is provided.

Although only certain embodiments of the present Invention have been expressly disclosed, such modifications as would be apparent to the person of ordinary skill may be made without departing from the scope or spirit thereof. The resilient spring contact is shown herein only on the bulb terminal. However, there is nothing to prevent locating this element on the connector terminal or on both terminals. In addition, it is also possible, within the present Invention, to have each terminal preventing the other from being withdrawn from the main housing. In this modification, each would be attached to the main housing without being fixed so that the desired relatively displacement can occur.

As can be seen from the foregoing, the present Invention is intended to be broadly construed and not to be limited except by the character of the claims appended hereto.

What we claim is:

1. A device for interconnection of a bulb with a power source comprising a generally cylindrical bulb socket having a first longitudinal axis and having a bulb opening at a first end, said bulb socket adapted to receive a bulb through said bulb opening;

a generally cylindrical connector socket having a second longitudinal axis and having a power source opening at an outer end, said cylindrical connector socket adapted to receive a connection from said source through said source opening, said first axis being at a substantially right angle to said second axis;

a connection chamber in communication with said bulb socket at a second end thereof remote from said first end and in connection with said connector socket at an inner end thereof remote from said outer end, a connector terminal in said connector socket having a leading end extending into said connection chamber, a bulb terminal in said bulb socket having an insertion end extending into said connection chamber, at least one of said insertion end and said leading end comprising a cantilevered spring contact fixed at its proximal end to said insertion end, a retaining plate adjacent said spring contact at a point remote from said proximal end, said spring contact being biased toward said retaining plate, said leading end being held between said plate and said spring contact, an engaging element on said retaining plate comprising a claw extending toward said leading end in an insertion direction of said bulb terminal, a locking hole in said leading end into which a distal end of said claw extends, said distal end bearing against a side of said locking hole remote from said connector socket.

2. A device for interconnection of a bulb with a power source comprising a generally cylindrical bulb socket having a first longitudinal axis and having a bulb opening at a first end, said bulb socket adapted to receive a bulb through said bulb opening;

a generally cylindrical connector socket having a second longitudinal axis and having a power source opening at an outer end, said cylindrical connector socket adapted to receive said source through said source opening, said first axis being at a substantially right angle to said second axis;

a connection chamber in communication with said bulb socket at a second end thereof remote from said first end and in connection with said connector socket at an inner end thereof remote from said outer end, a connector terminal in said connector socket having a leading end extending into said connection chamber, a bulb terminal in said bulb socket having an insertion end extending into said connection chamber, at least one of said insertion end and said leading end comprising a cantilevered spring contact fixed at its proximal end to said insertion end, a retaining plate adjacent said spring contact at a point remote from said proximal end, said spring contact being biased toward said retaining plate, said leading end being held between said plate and said spring contact, a claw on said leading end extending toward said retaining plate in an insertion direction of said bulb terminal, a locking hole in said insertion end into which a distal end of said claw extends, said distal end bearing against a side of said locking hole remote from said bulb socket.

3. A device for interconnection of a bulb with a power source comprising a generally cylindrical bulb socket having a first longitudinal axis and having a bulb opening at a first end, said bulb socket adapted to receive said bulb through said bulb opening;

a generally cylindrical connector socket having a second longitudinal axis and having a power source opening at an outer end, said cylindrical connector socket adapted to be connected to said source through said source opening, said first axis being at a substantially right angle to said second axis;

a connection chamber in communication with said bulb socket at a second end thereof remote from said first end and in connection with said connector socket at an inner end thereof remote from said outer end, a connector terminal in said connector socket having a leading end extending into said connection chamber, an engaging element on said leading end, a bulb terminal in said bulb socket having an insertion end extending into said connection chamber, at least one of said insertion end and said leading end comprising a cantilevered spring contact fixed thereto at its proximal end, a retaining plate adjacent said spring contact at a point remote from said proximal end, said spring contact being biased toward said retaining plate, said leading end being held between said plate and said spring contact;

said retaining plate comprising a window at said point, said engaging element being a U-shaped member having one leg attached to said leading end, said window adapted to receive at least a part of said member as said leading end is inserted between said plate and said spring contact.

4. A device for interconnection of a bulb with a power source comprising a generally cylindrical bulb socket having a first longitudinal axis and having a bulb opening at a first end, said bulb socket adapted to receive said bulb through said bulb opening;

a generally cylindrical connector socket having a second longitudinal axis and having a power source opening at an outer end, said cylindrical connector socket adapted to be connected to said source through said source opening, said first axis being at a substantially right angle to said second axis;

a connection chamber in communication with said bulb socket at a second end thereof remote from said first end and in connection with said connector socket at an inner end thereof remote from said outer end, a connector terminal in said connector socket having a leading end extending into said connection chamber, an engaging element on said leading end, a bulb terminal in said bulb socket having an insertion end extending into said connection chamber, at least one of said insertion end and said leading end comprising a cantilevered spring contact fixed thereto at its proximal end, a retaining plate adjacent said spring contact at a point remote from said proximal end, said spring contact being biased toward said retaining plate, said leading end being held between said plate and said spring contact;

said engaging element being a claw on said insertion end, extending from said insertion end toward said plate in a direction opposite to an insertion direction of said connector terminal, a locking hole in said leading end into which a distal end of said claw extends, said distal end bearing against a side of said locking hole remote from said connector socket thereby preventing withdrawal of said connector terminal from said connection chamber.

5. The device of claim 3 wherein said retaining plate has a retainer at an edge remote from said connector socket, whereby said U-shaped member hooks thereover when said member is inserted past said point between said plate and said spring member.

* * * * *